US009407033B2

(12) United States Patent
Kong et al.

(10) Patent No.: US 9,407,033 B2
(45) Date of Patent: Aug. 2, 2016

(54) ELECTRIC POWER RECEPTACLE

(71) Applicant: Crestron Electronics, Inc., Rockleigh, NJ (US)

(72) Inventors: Kian-Mun Kong, River Vale, NJ (US); George Feldstein, Cresskill, NJ (US); Wendy Feldstein, Old Tappan, NY (US); Dhirendra Patel, Edison, NJ (US); Sanjay Upasani, Manalapan, NJ (US)

(73) Assignee: Crestron Electronics Inc., Rockleigh, NJ (US)

( * ) Notice: Subject to any disclaimer, the term of this patent is extended or adjusted under 35 U.S.C. 154(b) by 0 days.

(21) Appl. No.: 14/601,161

(22) Filed: Jan. 20, 2015

(65) Prior Publication Data

US 2015/0255914 A1 Sep. 10, 2015

Related U.S. Application Data

(60) Provisional application No. 61/929,440, filed on Jan. 20, 2014.

(51) Int. Cl.

| | |
|---|---|
| ***H01R 13/648*** | (2006.01) |
| ***H01R 13/52*** | (2006.01) |
| *H01R 103/00* | (2006.01) |
| *H01R 24/78* | (2011.01) |

(52) U.S. Cl.

CPC ..... *H01R 13/5227* (2013.01); *H01R 24/78* (2013.01); *H01R 2103/00* (2013.01)

(58) Field of Classification Search

CPC ..... H01R 13/5227
USPC ..... 439/108, 137, 93, 107, 139, 145
See application file for complete search history.

(56) References Cited

U.S. PATENT DOCUMENTS

| | | | | |
|---|---|---|---|---|
| 4,669,789 | A * | 6/1987 | Pemberton | A47B 21/0073 312/194 |
| 5,006,075 | A * | 4/1991 | Bowden, Jr. | H01R 13/4534 439/137 |
| 5,186,639 | A * | 2/1993 | Comerci | H01R 13/7035 200/51.09 |
| 5,230,552 | A | 7/1993 | Schipper | |
| 5,234,355 | A * | 8/1993 | Sosinski | H01R 13/213 439/337 |
| 5,281,154 | A * | 1/1994 | Comerci | H01F 27/06 336/107 |
| 5,791,921 | A * | 8/1998 | Lee | H01R 27/00 439/103 |
| 5,856,633 | A | 1/1999 | Zelkovsky | |
| 5,915,981 | A * | 6/1999 | Mehta | H01R 13/4534 439/137 |
| 5,984,700 | A * | 11/1999 | Chang | H01R 13/4532 439/139 |
| 6,056,564 | A * | 5/2000 | Huang | H01R 13/4534 439/137 |
| 6,224,401 | B1 * | 5/2001 | Yu | H01R 13/4532 439/139 |
| 6,290,512 | B1 | 9/2001 | Mullen | |
| 6,610,927 | B2 | 8/2003 | Dinh | |
| 6,612,081 | B2 | 9/2003 | Cole | |
| 6,619,975 | B2 * | 9/2003 | Bentley | H01R 13/6392 439/346 |
| 6,644,987 | B2 * | 11/2003 | Meleck | B60R 11/00 439/107 |
| 6,843,669 | B2 | 1/2005 | Drane | |
| 7,066,738 | B2 * | 6/2006 | Maegawa | H01R 31/06 439/35 |
| 7,312,393 | B2 | 12/2007 | McCarthy | |
| 7,388,164 | B2 | 6/2008 | Scanzillo | |
| 7,487,729 | B2 * | 2/2009 | Riddiford | A47B 21/00 108/50.01 |

(Continued)

*Primary Examiner* — Tulsidas C Patel
*Assistant Examiner* — Peter G Leigh
(74) *Attorney, Agent, or Firm* — Crestron Electronics, Inc

(57) ABSTRACT

A touch screen device includes an electric power receptacle configured for being spill resistant. The electric power receptacle provides a fluidly isolated environment for each contact thereby allowing the electric power receptacle to pass a dielectric withstand test.

22 Claims, 8 Drawing Sheets

(56) References Cited

U.S. PATENT DOCUMENTS

| | | | | |
|---|---|---|---|---|
| 7,666,010 | B2 * | 2/2010 | Arenas | H01R 9/2491 439/107 |
| 7,938,676 | B1 * | 5/2011 | Patel | H01Q 1/2233 439/137 |
| 8,013,242 | B1 | 9/2011 | Thibault | |
| 8,119,910 | B1 | 2/2012 | Golden | |
| 2003/0236010 | A1 * | 12/2003 | Gorman | H01R 31/065 439/107 |
| 2004/0009689 | A1 * | 1/2004 | Wang | H01R 13/5213 439/139 |
| 2004/0083658 | A1 * | 5/2004 | Laukuf | E04B 2/7416 52/36.4 |
| 2008/0156512 | A1 * | 7/2008 | Castaldo | H01R 13/4534 174/53 |
| 2009/0227131 | A1 * | 9/2009 | Carbone | H01R 13/4534 439/149 |
| 2010/0173508 | A1 * | 7/2010 | Ortega | H01R 25/006 439/107 |
| 2010/0218374 | A1 * | 9/2010 | Gorman | H01R 31/065 29/876 |
| 2011/0130016 | A1 * | 6/2011 | Lacey | H02G 3/18 439/108 |

* cited by examiner

ELECTRIC POWER RECEPTACLE

BACKGROUND OF THE INVENTION

1. Technical Field

The present invention relates generally to electric power receptacles. More particularly, the invention relates to electric power receptacles in furniture power distribution units.

2. Background Art

Electric power receptacles provide electric power to an electrical device. Typically, electric power receptacles provide power from a 120 Volt (V) 60 Hertz (Hz) alternating current (AC) mains power supply.

Furniture power distribution units (FPDU) incorporate an electric power receptacle into stationary or fixed furniture in residential and commercial facilities. For example, an outlet may be placed in a chair for providing electric power to a user while sitting in the chair.

Tabletop control and cable management devices are employed in a corporate facility to provide a control and communication interface to users. In particular, touch screens incorporating some combination of a graphical user interface (GUI), control buttons, audiovisual (AV) and communication ports are increasingly being installed in corporate environments. Users desire that these touch screen devices include an electric power receptacle to provide power to various business and presentation devices such as laptop and tablet computers, smartphones, projection devices and speakers.

To be certified by certain safety organizations, FPDUs with electric power receptacles must conform to particular specifications or complete certain tests. One such test is a dielectric voltage withstand test, such as the type required by Underwriter Laboratories (UL) headquartered in Northbrook, Ill. A dielectric voltage withstand test involves placing a high voltage across the insulation barrier of a device for a certain period of time after a liquid is spilled in the receptacle. If the insulation holds the voltage after a spill, the device is deemed to have passed the test.

There is now a need for a tabletop interface device that includes an electric power receptacle in conformance with certain certification standards for a furniture power distribution unit.

SUMMARY OF THE INVENTION

It is to be understood that both the general and detailed descriptions that follow are exemplary and explanatory only and are not restrictive of the invention.

DISCLOSURE OF INVENTION

Principles of the invention provide a tabletop interface device including a spill resistant electric power receptacle. In a first aspect, an electric power receptacle includes a main receptacle body and a rear receptacle cover. The main receptacle body includes one or more cavities. Each of the cavities is configured for receiving an electrical contact further include a drainage slot configured for facilitating liquid drainage from the cavity and a rib slot configured for receiving an isolation rib. The one or more rear receptacle covers are configured for removably fastening to the main receptacle body and further include at least one contact support for supporting an electrical contact and an isolation rib protruding from the rear receptacle cover and configured for isolating the one or more cavities of the main receptacle body when the rear receptacle cover is coupled to the main receptacle body via communication between the one or more rib slots and the isolation rib.

In a second aspect, an interface device includes a bucket portion configured for being inserted into an opening of a surface. The bucket portion further includes an electric power receptacle and the electric power receptacle includes an external housing, a main receptacle body and a rear receptacle cover. The external housing is configured for being affixed to the bucket portion. The main receptacle body includes a front face, a first cavity, second cavity, third cavity, fourth cavity, fifth cavity and sixth cavity. The front face includes a hot plug terminal, neutral plug terminal and ground pin terminal. Each of the hot plug terminal, neutral plug terminal and ground pin terminal are configured for receiving a plug. Each of the first cavity, second cavity and third cavity comprise a drainage slot and a rib slot. Each of the one or more cavities and the drainage slots are dimensioned to drain liquid entering through an opening in a front face of the main receptacle body at a rate such that the liquid does not breach the opening in the front face. The rear receptacle cover further includes at least one contact support for supporting an electrical contact and an isolation rib. The isolation rib protrudes from the rear receptacle cover and configured for isolating the one or more cavities of the main receptacle body when said rear receptacle cover is coupled to the main receptacle body via communication between the one or more rib slots and the isolation rib.

The present invention seeks to overcome or at least ameliorate one or more of several problems, including but not limited to: providing a touch screen with an electric power receptacle that is spill resistant.

BRIEF DESCRIPTION OF DRAWINGS

The accompanying figures further illustrate the present invention.

The components in the drawings are not necessarily drawn to scale, emphasis instead being placed upon clearly illustrating the principles of the present invention. In the drawings, like reference numerals designate corresponding parts throughout the several views.

BRIEF DESCRIPTION OF THE SEVERAL VIEWS OF THE DRAWING

Figure 1:
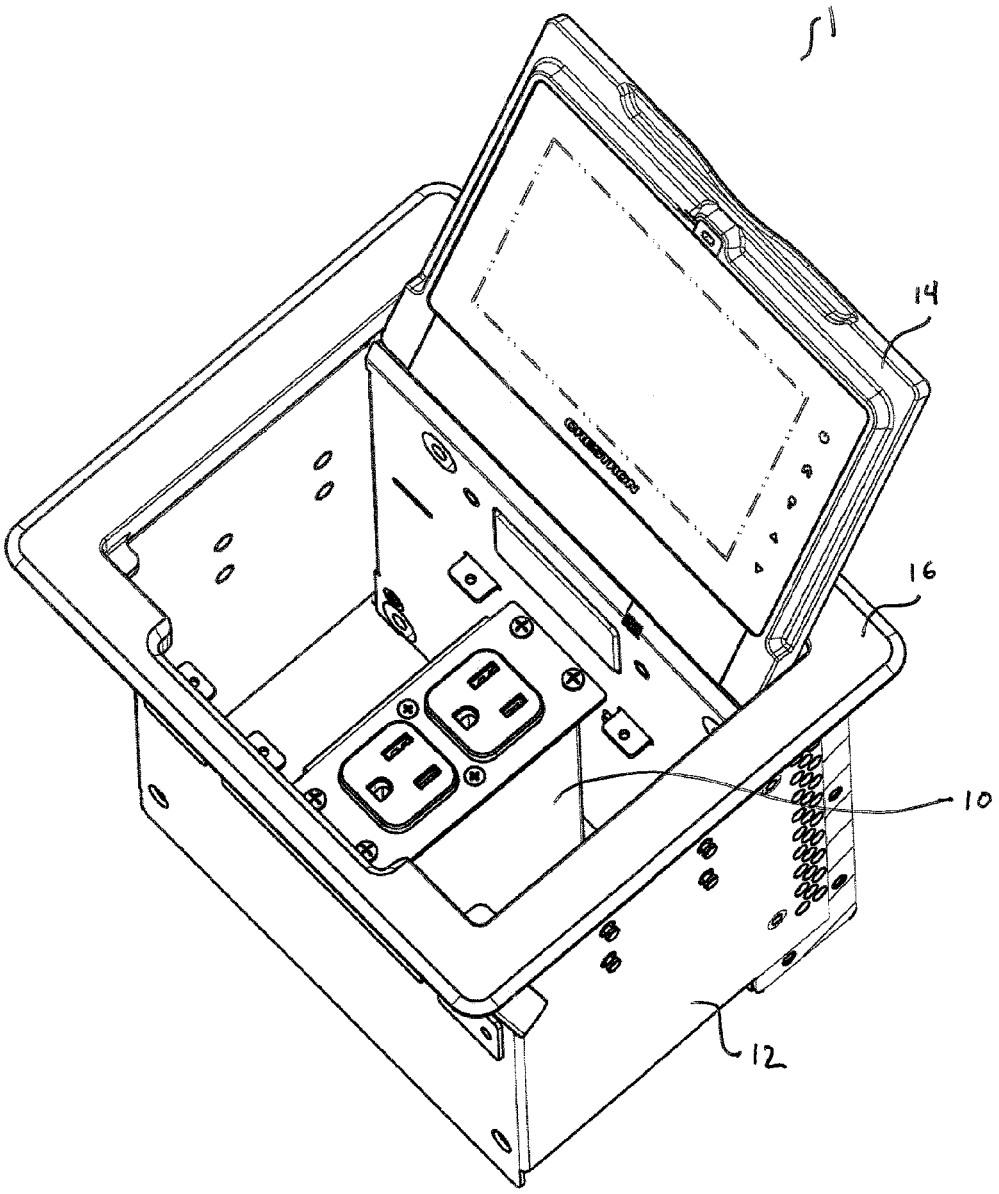

FIG. 1 is a touch screen assembly with a spill resistant electric power receptacle in accordance with an illustrative embodiment of the invention.

Figure 2C:
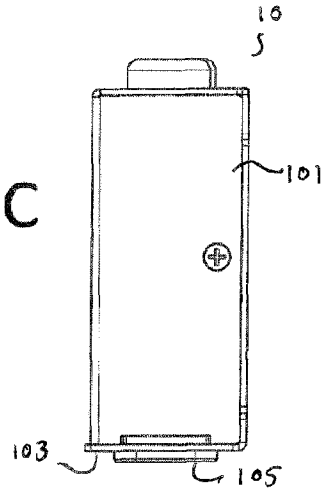
Figure 2A:
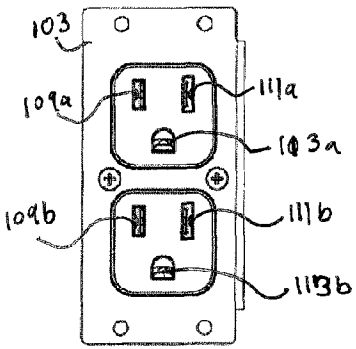

FIG. 2A is a front view of a spill resistant electric power receptacle in accordance with an illustrative embodiment of the invention.

Figure 2B:
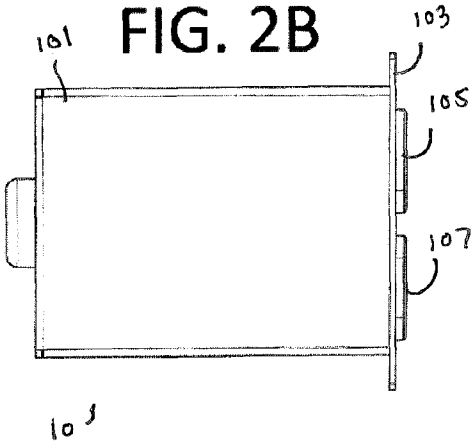

FIG. 2B is a side view of the spill resistant electric power receptacle in accordance with an illustrative embodiment of the invention.

FIG. 2C is a top view of the spill resistant electric power receptacle in accordance with an illustrative embodiment of the invention.

Figure 2D:
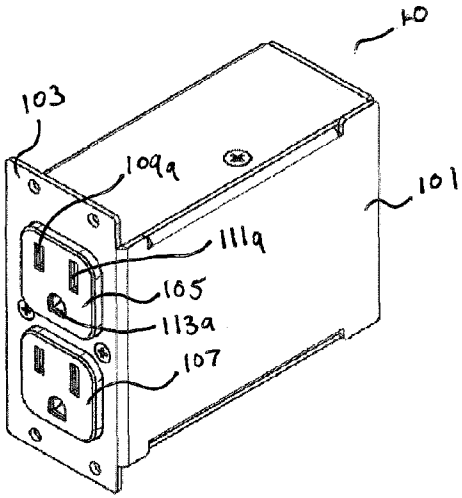

FIG. 2D is a front perspective view of the spill resistant electric power receptacle in accordance with an illustrative embodiment of the invention.

Figure 3:
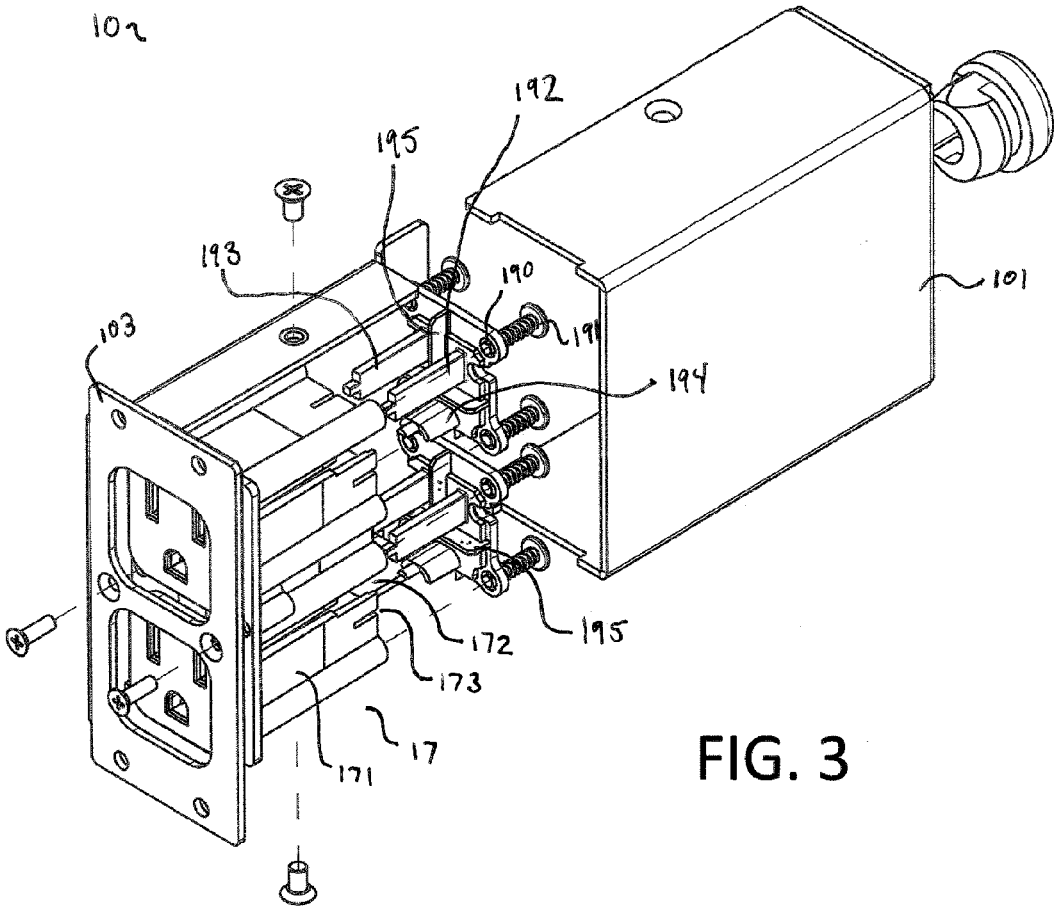

FIG. 3 is an exploded view of the spill resistant electric power receptacle in accordance with an illustrative embodiment of the invention.

Figure 4:
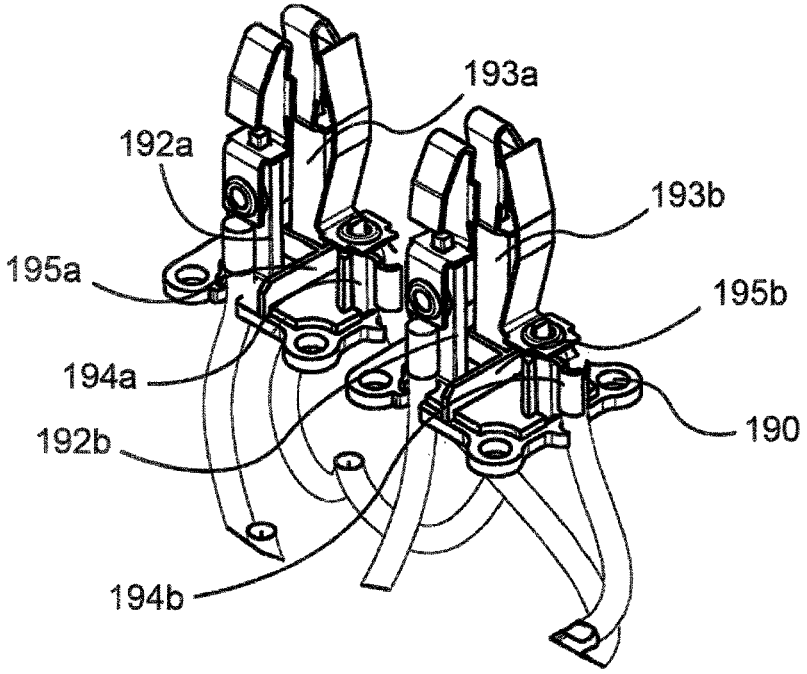

FIG. 4 shows the rear receptacle cover of the electric power receptacle in accordance with an illustrative embodiment of the invention.

Figure 5A:
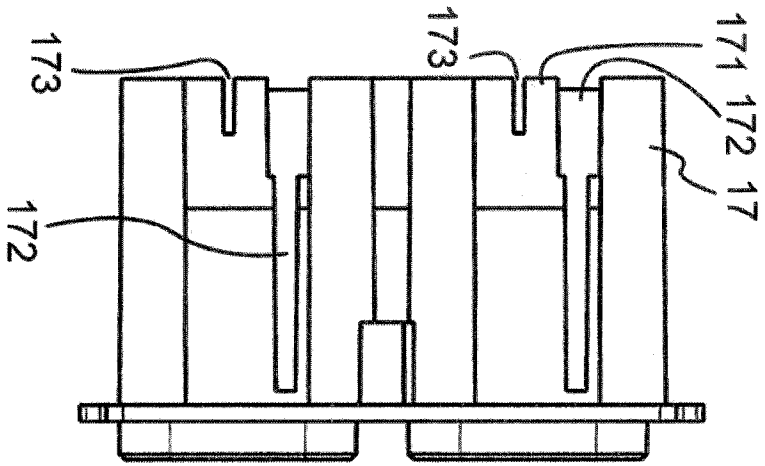

FIG. 5A is a side view of a main receptacle body for the spill resistant electric power receptacle in accordance with an illustrative embodiment of the invention.

Figure 5B:
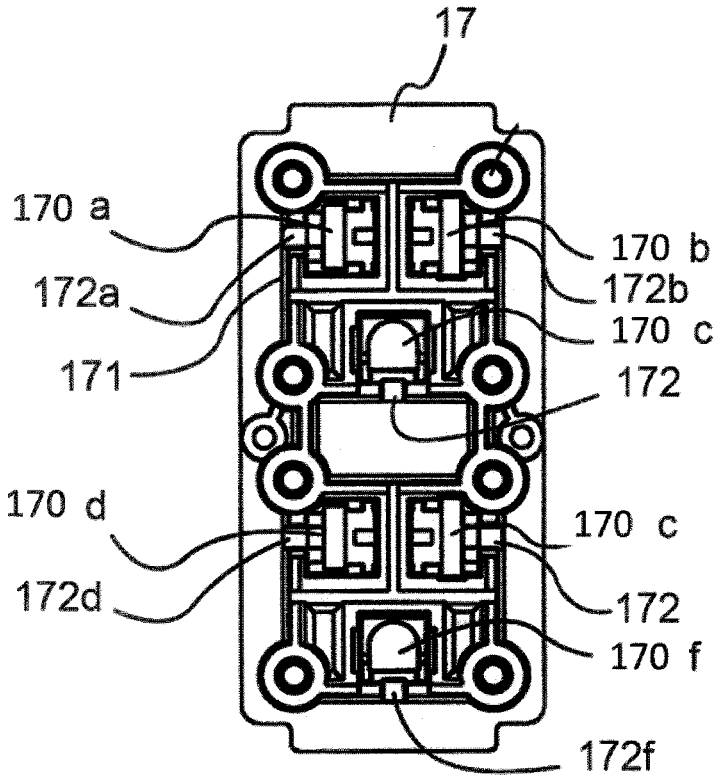

FIG. 5B is a back view of the main receptacle body for the spill resistant electric power receptacle in accordance with an illustrative embodiment of the invention.

Figure 5C:
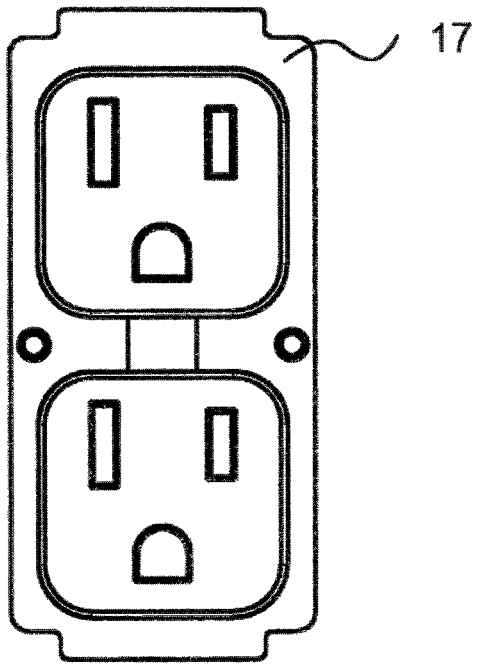

FIG. 5C is a front view of the main receptacle body for the spill resistant electric power receptacle in accordance with an illustrative embodiment of the invention.

Figure 6:
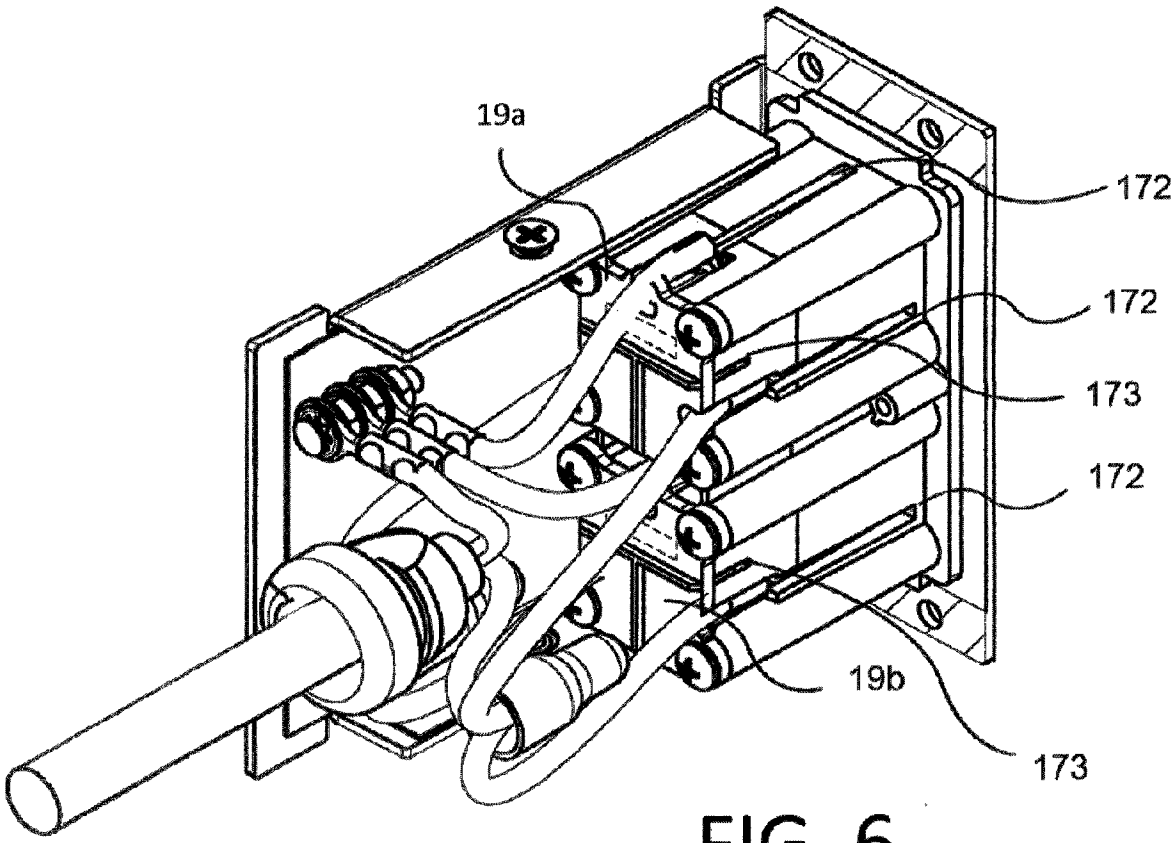

FIG. 6 is a back perspective view of the spill resistant electric power receptacle with a portion of the external housing removed in accordance with an illustrative embodiment of the invention.

LIST OF REFERENCE NUMBERS FOR THE MAJOR ELEMENTS IN THE DRAWING

The following is a list of the major elements in the drawings in numerical order.

1 touch screen assembly
10 electric power receptacle
12 bucket
14 lid
16 bezel portion
17 main receptacle body
19 rear receptacle cover (collectively the rear receptacle covers of a . . . b)
101 external housing (p/o of electric power receptacle 10)
103 front plate (p/o of electric power receptacle 10)
105 first outlet face
107 second outlet face
109 hot plug terminal (collectively the hot plug terminals of 109*a* . . . *b*)
111 neutral plug terminal (collectively the neutral plug terminals of 111*a* . . . *b*)
113 ground plug terminal (collectively the ground plug terminals of 113*a* . . . *b*)
170 cavity (collectively the cavities of 170*a-f*)
171 cavity wall (collectively the cavity walls of 171*a-f*)
172 drainage slot (collectively the drainage slots of 172*a-e*)
173 rib slot (collectively the rib slots of 173*a-e*)
190 fastener opening (p/o rear receptacle cover 19 and collectively the fastener openings of 190*a-h*)
191 fastener
192 hot contact support (collectively the hot contact supports of 192*a* . . . *b*)
193 neutral contact support (collectively the neutral contact supports of 193*a* . . . *b*)
194 ground pin support (collectively the ground supports of 194*a* . . . *b*)
195 isolation rib (collectively the isolation ribs of 195*a* . . . *b*)

DETAILED DESCRIPTION OF THE INVENTION

Mode(s) for Carrying Out the Invention

The present invention discloses a tabletop interface device comprising an electric power receptacle configured for being spill resistant. The electric power receptacle further comprises elongated electrical contacts which are isolated from each other by cavities in an elongated main receptacle body. A rear receptacle cover further comprises raised portions which interconnect with the main receptacle body forming isolated cavities to keep liquid from entering one cavity from another. Advantageously, the electric receptacle does not require potting or a hard-wire connection to ground.

The tabletop interface device is configured for providing an electric power receptacle to a surface such as a horizontal tabletop surface. The electric power receptacle may be a stand-alone device or may be part of a more robust assembly providing more functionality to a user. In an embodiment, the tabletop interface device is a touch screen interface providing cable connections and control buttons. The control buttons may be used to control devices such as lighting devices, shade devices, AV devices, HVAC devices, security devices or any other controllable device. For example, the tabletop interface device may be a Crestron® Connect-It Presentation Interface or a Crestron FlipTop™ Touch Screen or Touch Screen Control System available from Crestron Electronics, Inc. of Rockleigh, N.J.

When installed in a surface, the electric power receptacle of the tabletop interface may be flush with the table top surface, raised above, below the horizontal surface or some combination of the above. In addition, the electric power receptacle may be at an angle to the table top surface or parallel with the surface. Finally, the mounting surface may be a horizontal surface such as a table, a vertical surface such as a wall or at an angle such as on a podium.

FIG. 1 is a touch screen assembly 1 with a spill resistant electric power receptacle 10 in accordance with an illustrative embodiment of the invention. The touch screen assembly 1 comprises a bucket 12, a lid 14, and a bezel 16. The touch screen assembly 1 is configured to be mounted on a surface such that the bucket 12 is inserted into an opening formed in the mounting surface and is substantially below the mounting surface when mounted. When mounted, the bezel 16 is in contact with and parallel to the mounting surface.

The touch screen assembly 1 further comprises a lid 14 which is a hinged lid similar to those found in the FlipTop™ line of touch screens available from Crestron Electronics of Rockleigh N.J. An exterior surface of the lid 14 provides a cover for the bucket 12 of the touch screen assembly 1 when in a closed position. When in a closed position, the lid 14 of the touch screen assembly is substantially parallel with the tabletop surface or at 0 degrees with the tabletop surface. The interior portion of the lid 14 provides a user interface when in an open position. An open position is any angle from greater than zero (0) degrees to one-hundred (180) degrees.

In the embodiment shown in FIG. 1, the lid 14 comprises a touch screen providing a graphic user interface as well as a plurality of physical buttons. In other embodiments, the lid 14 may provide some other arrangement of one or more of the following: touch screen, physical buttons, decorative face.

The bucket portion 12 further comprises an electric power receptacle 10 positioned such that a front face of the power receptacle 10 is facing toward the surface opening thereby providing convenient access for plugs. The electric power receptacle 10 is configured for providing electric power to one or more electrical devices via an inserted plug. In the embodiment shown in FIG. 1, the electric power receptacle 10 is a duplex receptacle offering two outlets. In other embodiments, the electric power receptacle 10 may offer a single outlet or more than two outlets.

In corporate and residential installations in the United States, the electric power receptacle 10 will commonly provide power from an a 120 V 60 Hz AC mains power supply. In other embodiments, the duplex receptacle may be providing power at different voltage and frequency such as 230 V and 50 Hz.

FIG. 2A is a front view of a spill resistant electric power receptacle in accordance with an illustrative embodiment. FIG. 2B is a side view of the spill resistant electric power receptacle in accordance with an illustrative embodiment.

FIG. 2C is a top view of the spill resistant electric power receptacle in accordance with an illustrative embodiment. FIG. 2D is a front perspective view of the spill resistant electric power receptacle in accordance with an illustrative embodiment.

The electric power receptacle 10 comprises an external housing 101. The external housing 101 protects a main receptacle body 17 and fastens to the touch screen assembly 1. A front plate 103 of the external housing 101 is configured for being attached to a surface of the touch screen assembly 1 via four fastener holes formed in the front plate 103. The front plate 103 further comprises two openings, each dimensioned for an outlet face 105, 107 to extend through the opening.

Electrical wires enter the external housing 101 through an opening in a rear face of the external housing 101. For example, a hot conductor wire, neutral conductor wire and a ground conductor wire may enter the external housing 101 through the rear face of the external housing 101.

In an embodiment, the external housing 101 is composed of two pieces of sheet metal. The two metal sheets are fastened via a fastener such as a threaded screw.

A first outlet face 105 and a second outlet face 107 protrude through the front plate 103. The face of each receptacle provides a hot plug terminal 109, a neutral plug terminal 111 and a ground pin terminal 113. The hot plug terminal 109 and neutral plug terminal 111 are aligned with and dimensioned for receiving a first blade and a second blade of a plug.

The first outlet face 105 and second outlet face 107 are each aligned with and dimensioned to receive plugs compliant with industry standards such as the National Electrical Code (NEC) and the National Electrical Manufacturers Association (NEMA). In this embodiment, the dimensions of the openings are dimensioned as a standard receptacle in accordance with "NEMA 5-15". Therefore, the hot plug terminal 109 and neutral plug terminal 111 of each electric receptacle are dimensioned to receive plug blades that comply with U.S. ANSI/NEMA standard WD 6-2002 sheet 1-15 ("NEMA 1-15") for 110 V, 15 A, 2 wire plugs. That is to say, the neutral blade has a length that is between 0.625 and 0.718 inches, a height that is between 0.307 and 0.322 inches, and a width that is approximately 0.06 inches. The hot blade has a length that is between 0.625 and 0.718 inches, a height that is between 0.24 and 0.26 inches, and a width that is approximately 0.06 inches.

Although the embodiment shown in FIG. 2A-D includes hot and neutral plug terminals that are flat blades, the invention could also be applied to receptacles dimensioned to receive plugs having hot and neutral conductors in other shapes and orientations. These could include, for example, D- or U-shaped conductors of U.S. ANSI/NEMA standard WD 6-2002 sheet 5-15 ("NEMA 5-15"), or square, circular, L or T-shaped conductors.

FIG. 3 is an exploded view of the spill resistant electric power receptacle 10 in accordance with an illustrative embodiment. In this view, portions of the external housing 101 have been separated to show a main receptacle body 17, a first rear receptacle cover 19*a* and a second rear receptacle cover 19*b*. Each of the first rear receptacle cover 19*a* and the second rear receptacle cover 19*b* are dimensioned to interlock together. Each of the first rear receptacle cover 19*a* and second rear receptacle cover 19*b* further comprises four fastener openings 190*a-h* extending laterally through the portion and configured for each receiving a fastener 191*a-h*, such as a threaded screw. Each of the eight total fastener openings 190*a-h* of the first rear receptacle cover 19*a* and second rear receptacle cover 19*b* is aligned with a corresponding fastener opening in the main receptacle body 17. The corresponding fastener openings of the main receptacle body 17 receive a fastener 191*a-h*, thereby securing the main receptacle body 17 to the first rear receptacle cover 19*a* and the second rear receptacle cover 19*b*.

The first rear receptacle cover 19*a* and second rear receptacle cover 19*b* each further comprise a hot contact support 192*a-b* and a neutral contact support 193*a-b*. The hot contact support 192*a-b*, neutral contact support 193*a-b* and ground contact support 194*a-b*, of each rear receptacle cover 19 protrude perpendicularly from the front face of the rear receptacle cover 19 and may be formed of a single piece of material with the rear receptacle cover body, such as from a single piece of plastic material at a specific grade to meet UL requirements. For example, the entire rear receptacle cover 19 may be formed from a single piece of plastic by a molding process, milling process or three dimensional printing process. Advantageously, this provides simple manufacturing and a minimum number of parts.

A ground contact may be attached to a ground support 194*a-b* protruding perpendicularly from the body of each of the first rear receptacle cover 19*a* and the second rear receptacle cover 19*b*. Each of the hot contact support 192 and neutral contact support 193 is configured for supporting an electrical contact and the ground contact support is configured for supporting a ground contact.

FIG. 4 shows the first rear receptacle cover and second rear receptacle cover of the receptacle in accordance with an illustrative embodiment. Each electrical contact attaches to the contact support and is configured for making conductive contact with a plug blade and either supplying or returning electrical power to the power supply via a wire. In the embodiment shown, a portion of the contact support extends through an opening in the electrical contact, thereby affixing the electric contact to the contact support. Each receptacle cover comprises a first groove, second groove and third groove for supporting the hot wire, neutral wire and ground wire in conductive connection with the electric contact.

The first rear receptacle cover 19*a* of the receptacle and the second rear receptacle cover 19*b* of the receptacle each further comprise an isolation rib 195*a-b*. The isolation rib is a raised portion in the shape of a "T". Each isolation rib comprises a main arm bisecting each rear receptacle cover 19 between the hot contact support and neutral contact support. The isolation rib further comprises a minor arm perpendicular from the main arm and separating the hot contact support and neutral contact support thereby further quartering that bisected half of the rear receptacle cover 19. As will be described in further detail below, the isolation rib 195*a-b* of each rear receptacle cover 19 ensure that fluid, such as a liquid, entering through the face of the receptacle does not form an electrical connection between two contacts supported by that portion, thereby causing a short.

FIG. 5A is a side view of a main receptacle body of the spill resistant electric power receptacle in accordance with an illustrative embodiment. FIG. 5B is a back view of the main receptacle body of the spill resistant electric power receptacle in accordance with an illustrative embodiment. FIG. 5C is a front view of the main receptacle body of the spill resistant electric power receptacle in accordance with an illustrative embodiment.

The main receptacle body 17 of the receptacle comprises a first isolation cavity 170*a*, a second isolation cavity 170*b*, a third isolation cavity 170*c*, a fourth isolation cavity 170*d*, a fifth isolation cavity 170*e* and a sixth isolation cavity 170*f*, each defined by an opening in a back surface of the main receptacle body 17. Each of the cavities 170*a-f* extends into the main receptacle body 17 toward the face and forms cavity walls 171 surrounding each cavity.

The cavities 170 are aligned with the terminal openings of the outlet faces 105, 107. The first cavity 170*a*, second cavity 170*b*, fourth cavity 170*d* and fifth cavity 170*e* are configured for receiving an electrical contact and a contact support 192, 193. The third cavity 170*c* and sixth cavity 170*e* are configured to receive a ground support 194 and associated ground contact.

The main receptacle body 17 further comprises a plurality of drainage slots 172*a-e* formed of openings in the cavity walls 171. The drainage slots 172*a-e* extend through the outside of the cavity wall 171 to the isolation cavity 170 and are positioned to allow any fluid such as a liquid that has entered a cavity 170, such as through the receptacle openings in the front face of the receptacle, to drain from that cavity 170 without shorting the electrical contacts. For example, the fluid may comprise liquid water or water vapor or some combination of the two. In the embodiment shown in FIG. 3, the main receptacle body 17 comprises a drainage slot 172 for each cavity 170 formed from an opening on the outer cavity wall 171 extending along the length of the wall and perpendicular to the front face of the main receptacle body 17. The drainage slots 172 extend from the rear surface of the main receptacle body 17 to substantially the front face of the main receptacle body 17, thereby maximizing the length of the drainage slot. Substantially to the front face of the main receptacle body does not require that the drainage slot extend the entire depth of the main receptacle body as it may be structurally beneficial to have material between the edge of the drainage slot and the front face of the main receptacle body.

The cavities and the drainage slots are dimensioned such that liquid drains from each cavity 170 at a rate greater than it can accumulate in the cavity 170 after entering through a plug terminal of the face. In particular, the cavities 170, electrical contacts and drainage slots are elongated to facilitate liquid drainage from the cavity 170. In the embodiment shown in FIGS. 5A, 5B and 5C, the depth of the main receptacle body 17 (i.e. the length of the cavity wall 171 from the rear surface of the main receptacle body 17 to the front surface of the main receptacle body 17 at the base of the outlet face) is approximately 1.48 inches. The height of the main receptacle body 17 at the rear surface is approximately 2.4 inches. The height of the outlet face 105, 107 is approximately 1 inch. Accordingly, the ratio of the depth of the main receptacle body 17, and therefore the length of the drainage slot, to the height of the outlet face 105, 107 is approximately three to two. Approximately three to two comprises ratios within a reasonable range of three to two which result in liquid draining from the drainage slot at a rate which is greater than it can accumulate in the cavity 170 after entering through a plug terminal of the face.

The main receptacle body 17 further comprises rib slots 173 formed in the opening in the cavity wall 171. The rib slots 173 are configured for receiving and communicating with the isolation ribs 195 of each of the rear receptacle covers 19*a-b* to further isolate each cavity 170 from the other cavities and ensure liquid which has entered one or more of the cavities does not create a short between electric contacts.

In an embodiment, the isolation rib 195 of each rear receptacle cover 19 is formed integrally from one piece of material, such as from a single piece of plastic material, with that rear receptacle cover 19*a-b*. For example, the entire rear receptacle cover 19 may be formed from a single piece of plastic at a specific grade to meet UL requirements and by a molding process, milling process or three dimensional printing process. Advantageously, this provides simple manufacturing and a minimum number of parts. Additionally, this provides convenient alignment and assembly with the main receptacle body 17. Alternatively, in another embodiment, the isolation rib 195 of each rear receptacle may be a mechanical gasket, such as an elastomer configured to attach to the rear receptacle cover 19 such as by fitting in a corresponding groove of the rear receptacle cover 19.

The drainage slots 172, in conjunction with the isolation ribs 195 and the rib slots 173, ensure that liquid entering a cavity 170 through the faceplate will drain out of the cavity 170 and away from any other electric contact. Accordingly, the electric contacts will not be shorted by any liquid entering and the receptacle can adequately pass a dielectric withstand test.

FIG. 6 is a back perspective view of the spill resistant electric power receptacle with a portion of the external housing 101 removed in accordance with an illustrative embodiment. The receptacle shown in FIG. 5 is connected as it would be during operation. The main receptacle body 17 and the first rear receptacle cover 19*a* and second rear receptacle cover 19*b* are interconnected, with the isolation ribs 195 inserted into the isolation slots 173. The eight threaded screws 191 are inserted through the fastener openings 190, 170 in the first rear receptacle cover 19*a*, second rear receptacle cover 19*b* and the main receptacle body 17 thereby securing the three portions together.

The electric contacts are connected to a power supply by a plurality of wires protruding through the external housing 101. A hot wire enters the external housing 101 and is connected to a first internal hot wire and a second internal hot wire via a wire connector. The first and second internal hot wire each supply electric power to an electrical contact in each receptacle. A neutral wire enters the external housing 101 and is connected to a first internal neutral wire and a second internal neutral wire via a wire connector. The first and second internal neutral wire each supply a return path to an electrical contact in each receptacle. A ground wire enters the external housing 101 and is connected to a common ground attached to the external housing 101. A ground wire runs from each ground contact to the common ground.

INDUSTRIAL APPLICABILITY

To solve the aforementioned problems, the present invention is a unique device in which an electric power receptacle 10 is provided in a touch screen assembly 1. The electric power receptacle 10 provides a fluidly isolated environment for each contact thereby allowing the electric power receptacle 10 to pass a dielectric withstand test.

LIST OF ACRONYMS USED IN THE DETAILED DESCRIPTION OF THE INVENTION

The following is a list of the acronyms used in the specification in alphabetical order.

A ampere
AC alternating current
ANSI American National Standards Institute
AV audiovisual
FPDU furniture power distribution unit
GUI graphical user interface
HVAC heating, ventilation, air conditioning
Hz Hertz
In inch
NEC National Electrical Code
NEMA National Electrical Manufacturers Association
UL Underwriters Laboratory
V Volt

ALTERNATE EMBODIMENTS

Alternate embodiments may be devised without departing from the spirit or the scope of the invention. For example, the electrical receptacle may accept plugs of a different size and orientation than a NEMA 5-15 plug.

What is claimed is:

1. An electric power receptacle, comprising:

(a) a main receptacle body, comprising:

(i) one or more cavities each configured for receiving an electrical contact at a top end of the cavity and for receiving contact support at a bottom end of the cavity, each of the one more cavities further comprising a drainage slot formed from an opening in a side face of the main receptacle body and extending along at least part of a length of the cavity such that fluid entering the cavity drains out from the side face, and (ii) a rib slot configured for receiving an isolation rib; and (b) one or more rear receptacle covers configured for removable fastening to the main receptacle body, and further comprising:

(i) one or more contact supports each extending from a surface of the one or more rear receptacle covers for supporting the electrical contact, and (ii) an isolation rib protruding from the surface of the rear receptacle cover and configured for insertion into the rib slot when the rear receptacle cover is coupled to the main receptacle body so that the rib slot and the isolation rib combine to electrically isolate the one or more cavities from each other.

2. The electric power receptacle of claim 1, wherein the one or more rear receptacle covers comprises one rear receptacle cover, the one or more contact supports further comprising a hot contact support, a neutral contact support and a ground contact support, and wherein the main receptacle body comprises three cavities, each of the cavities being aligned with one of the hot contact support, the neutral contact support or the ground contact support.

3. The electric power receptacle of claim 1, wherein the one or more rear receptacle covers comprises two rear receptacle covers, the one or more contact supports of each of the two rear receptacle covers further comprising a hot contact support, a neutral contact support and a ground contact support, and wherein the main receptacle body comprises six cavities, each of the cavities being aligned with one of the hot contact support, the neutral contact support, or the ground contact support of one of the two rear receptacle covers.

4. The electric power receptacle of claim 1 wherein each of the one or more cavities and the drainage slots are dimensioned to drain fluid entering the cavity through a terminal opening in an outlet face of the main receptacle body at a rate such that fluid accumulating in the cavity does not breach the terminal opening in the outlet face.

5. The electric power receptacle of claim 4 wherein the depth of the main receptacle body is greater than the height of the outlet face.

6. The electric power receptacle of claim 5 wherein the ratio of the length of the drainage slot to the height of the outlet face is approximately three to two.

7. The electric power receptacle of claim 1, wherein the one or more contact supports comprise a hot contact support and a neutral contact support, and the isolation rib comprises a main arm dividing the surface of the one or more rear receptacle covers into regions that include a region from which the hot contact support and the neutral contact support extend, and a minor arm intersecting the main arm and further dividing the surface of the one or more rear receptacle covers by separating the hot contact support from the neutral contact support.

8. The electric power receptacle of claim 7 wherein the isolation rib and the one or more rear receptacle covers are formed of a single material.

9. The electric power receptacle of claim 7 wherein the isolation rib is a gasket affixed to the surface of the one or more rear receptacle covers.

10. The electric power receptacle of claim 7, wherein a ground contact support extends from another of the regions separated by the main arm of the isolation rib.

11. An interface device, comprising:

a bucket portion configured for being inserted into an opening of a surface; and an electric power receptacle, comprising:

(a) an external housing configured for being affixed to an interior cavity of the bucket portion;

(b) a main receptacle body, further comprising:

(i) an outlet face, comprising a hot plug terminal, a neutral plug terminal and a ground pin terminal each configured for receiving a corresponding plug conductor, (ii) a first cavity, a second cavity, a third cavity each comprising a respective drainage slot formed from an opening in a side face of the main receptacle body and extending along at least part of a length of the cavity such that fluid entering the cavity drains out from the side face, and (iii) wherein the length of each of the first cavity, the second cavity and the third cavity and the length of the drainage slots are dimensioned such that fluid entering the cavity through a terminal opening in an outlet face of the main receptacle body drains out at a sufficient rate that fluid accumulating in the cavity does not breach the terminal opening in the outlet face, (iv) a rib slot configured for receiving an isolation rib; and (c) a rear receptacle cover, comprising (i) one or more contact supports each extending from a surface of the rear receptacle cover for supporting an electrical contact, and (ii) an isolation rib protruding from the surface of the rear receptacle cover and configured for insertion into the rib slot when the rear receptacle cover is coupled to the main receptacle body so that the rib slot and the isolation rib combine to electrically isolate the one or more cavities from each other.

12. The interface device of claim 11 wherein the surface into which the bucket portion is inserted is a horizontal surface.

13. The interface device of claim 11 wherein the outlet face of the electric power receptacle is parallel with the surface into which the bucket portion is inserted.

14. The interface device of claim 11 further comprising a lid configured for covering the interior cavity of the bucket portion when operating in a closed position.

15. The interface device of claim 14 wherein the lid is configured for providing access to a user interface when operating in an open position.

16. The interface device of claim 15 wherein the user interface comprises a graphical user interface.

17. The interface device of claim 11 further comprising one or more cable interfaces.

18. An electric power receptacle, comprising:

(a) a main receptacle body, comprising:

(i) a plurality of cavities separated by one or more inner walls of the main receptacle body, each of the plurality of cavities configured for receiving an electrical contact and further comprising a drainage slot formed in a side face of the main receptacle body for facilitating fluid drainage from that cavity, and (ii) a rib slot configured for receiving an isolation rib and formed in an end of the one or more inner walls of the main receptacle body; and (b) one or more rear receptacle covers configured for removable fastening to the main receptacle body, each comprising:

(i) a plurality of contact supports each extending from a surface of the one or more rear receptacle covers for supporting an electrical contact, and (ii) an isolation rib protruding from the surface of the one or more rear receptacle covers, at least a segment of the isolation rib being configured for insertion into an equal length segment of the rib slot when the rear receptacle cover is coupled to the main receptacle body so that the segment of the rib slot and the segment of the isolation rib combine to electrically isolate the plurality of cavities of the main receptacle body from each other.

19. The electric power receptacle of claim 18, wherein the plurality of contact supports comprise a hot contact support and a neutral contact support, one of the one or more cavities of the main receptacle body is configured for receiving the hot contact support and another of the one or more cavities of the main receptacle body is configured for receiving the neutral contact support when the rear receptacle cover is coupled to the main receptacle body, and the isolation rib is disposed between the hot contact support and the neutral contact support.

20. The electric power receptacle of claim 19, wherein when the rear receptacle cover is coupled to the main receptacle body, the isolation rib and the rib slot combine to electrically isolate the cavity receiving the hot contact support from the cavity receiving the neutral contact support.

21. The electric power receptacle of claim 19, wherein the plurality of contact supports further comprises a ground contact support, a further one of the one or more cavities of the main receptacle body is configured for receiving the ground contact support when the rear receptacle cover is coupled to the main receptacle body, a major arm of the isolation rib is disposed between the hot contact support and the neutral contact support, and a minor arm of the isolation rib intersects the major arm and further divides the surface of the one or more rear receptacle covers into a region from which the hot contact support and the neutral contact support extend and a further region from which the ground contact support extends.

22. The electric power receptacle of claim 21, wherein when the rear receptacle cover is coupled to the main receptacle body, the isolation rib and the rib slot combine to electrically isolate the cavity receiving the hot contact support, the cavity receiving the neutral contact support, and the cavity receiving the ground contact support from each other.

* * * * *